US009870683B1

(12) United States Patent
Pious

(10) Patent No.: US 9,870,683 B1
(45) Date of Patent: Jan. 16, 2018

(54) LUGGAGE NOTIFICATION SYSTEM

(71) Applicant: Jerome Pious, Newman, CA (US)

(72) Inventor: Jerome Pious, Newman, CA (US)

( * ) Notice: Subject to any disclaimer, the term of this patent is extended or adjusted under 35 U.S.C. 154(b) by 50 days.

(21) Appl. No.: 15/132,437

(22) Filed: Apr. 19, 2016

(51) Int. Cl.
*G08B 13/14* (2006.01)
*G08B 13/08* (2006.01)

(52) U.S. Cl.
CPC ..... *G08B 13/14* (2013.01); *G08B 13/08* (2013.01)

(58) Field of Classification Search
CPC ..... G08B 13/14; G08B 13/08
See application file for complete search history.

(56) References Cited

U.S. PATENT DOCUMENTS

D147,825 S 11/1947 Wemyss
4,728,937 A 3/1988 Hsu
7,916,025 B2 3/2011 Locker
2006/0266563 A1 11/2006 Kaplan
2014/0139334 A1 5/2014 Dubarry
2014/0151173 A1 6/2014 Reh
2017/0074002 A1* 3/2017 Cooper ..... E05B 35/105
2017/0220040 A1* 8/2017 London ..... G05D 1/0088 701/26

FOREIGN PATENT DOCUMENTS

CN 103960853 A 8/2014

* cited by examiner

*Primary Examiner* — Curtis Odom
(74) *Attorney, Agent, or Firm* — Kyle A. Fletcher, Esq.

(57) ABSTRACT

The luggage notification system is a security and tracking system that is adapted for use with a piece of luggage. Specifically, the luggage notification system: 1) monitors when the piece of luggage is accessed for security or other reasons, records the event and transmits a message announcing the event; and, 2) tracks the position of the piece of luggage.

Optionally, the luggage notification system can further comprise a load cell to monitor the weight of the piece of luggage and a drive system that drives a plurality of rollers associated with the piece of luggage. The luggage notification system comprises a piece of luggage, a security system, a drive system, a weight system, and a control system.

13 Claims, 6 Drawing Sheets

LUGGAGE NOTIFICATION SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of data processing systems for administrative purposes, more specifically, a logistics system for monitoring the security and location of freight or other cargo.

Luggage is defined as a bag, suitcase, or parcel within which a person will carry their personal belongings during travel. The typical components of an item of luggage includes, but is not limited to, a case 141, a closure 143, a plurality of rollers 144, a handle 145, and an extendable handle 142.

Often through the course of travel, a person becomes physically separated from their luggage and no longer has the ability to personally ensure the security of their luggage or physically determine the location of their luggage. An unfortunate result of this physical separation is the loss of all or a portion of the personal items contained within the luggage. Clearly methods to ensure the security of luggage and to track luggage can dramatically improve the experience of travelling.

SUMMARY OF INVENTION

This disclosure addresses the above shortcomings of luggage.

The luggage notification system is a security and tracking system that is adapted for use with a piece of luggage. Specifically, the luggage notification system: 1) monitors when the piece of luggage is accessed for security or other reasons, records the event and transmits a message announcing the event; and, 2) tracks the position of the piece of luggage. Optionally, the luggage notification system can further comprise a load cell to monitor the weight of the piece of luggage and a drive system that drives a plurality of rollers associated with the piece of luggage.

These together with additional objects, features and advantages of the luggage notification system will be readily apparent to those of ordinary skill in the art upon reading the following detailed description of the presently preferred, but nonetheless illustrative, embodiments when taken in conjunction with the accompanying drawing.

In this respect, before explaining the current embodiments of the luggage notification system in detail, it is to be understood that the luggage notification system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the luggage notification system.

It is therefore important that the claims be regarded as including such equivalent construction insofar as they do not depart from the spirit and scope of the luggage notification system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
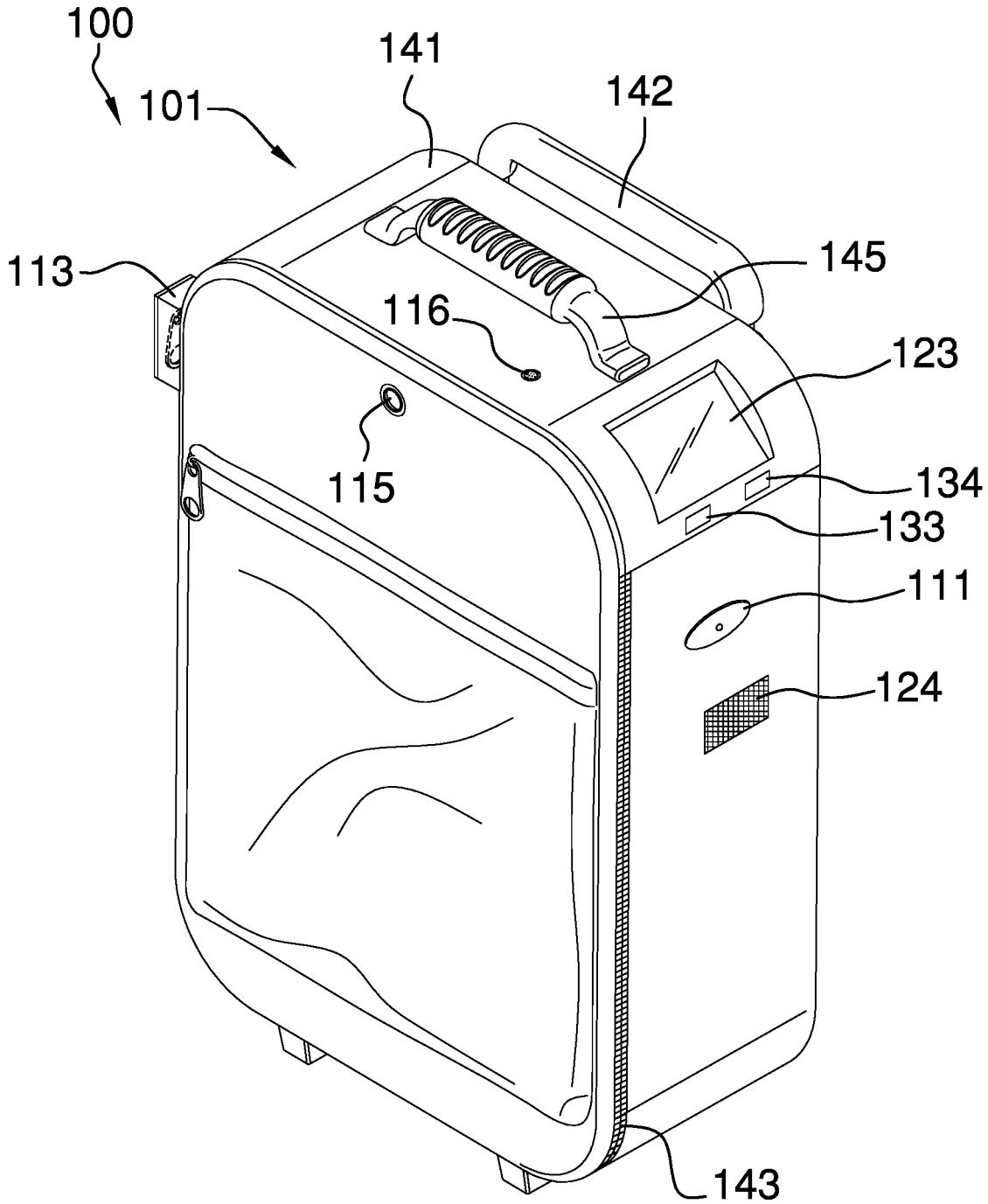
FIG. 1 is a perspective view of an embodiment of the disclosure.
Figure 2:
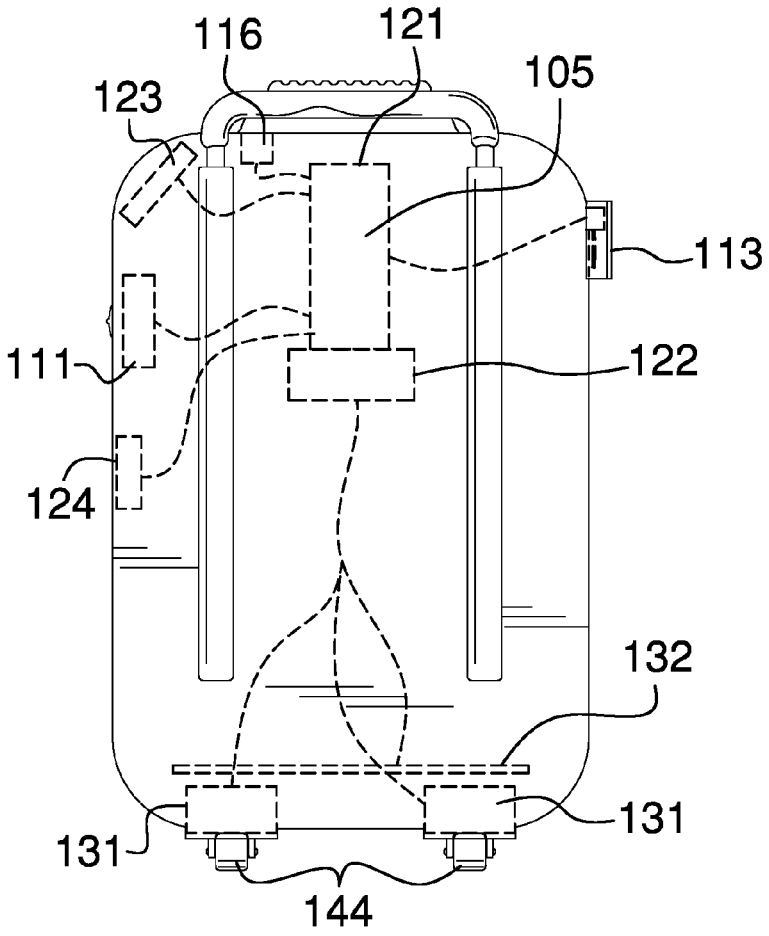
FIG. 2 is a rear view of an embodiment of the disclosure.
Figure 3:
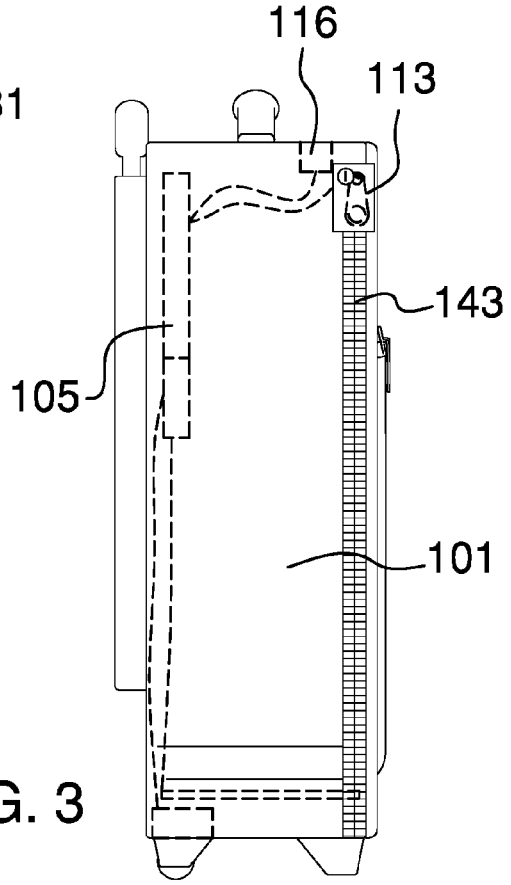
FIG. 3 is a side view of an embodiment of the disclosure.
Figure 4:
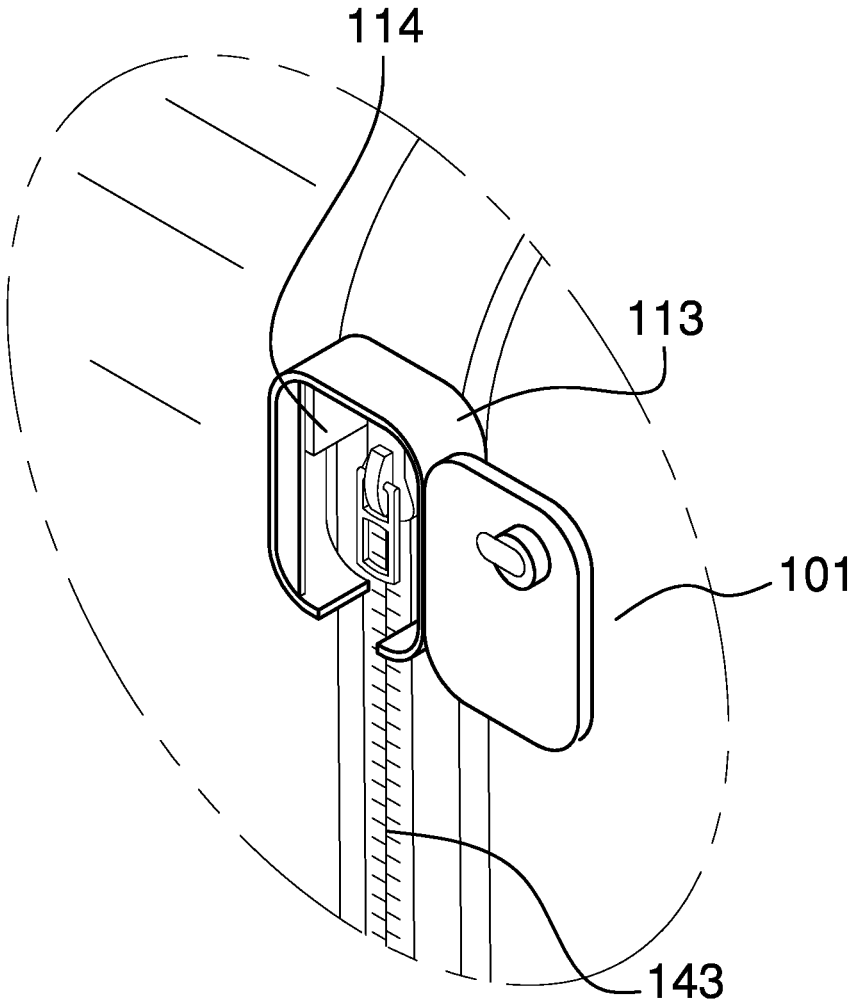
FIG. 4 is a detail view of an embodiment of the disclosure.
Figure 5:
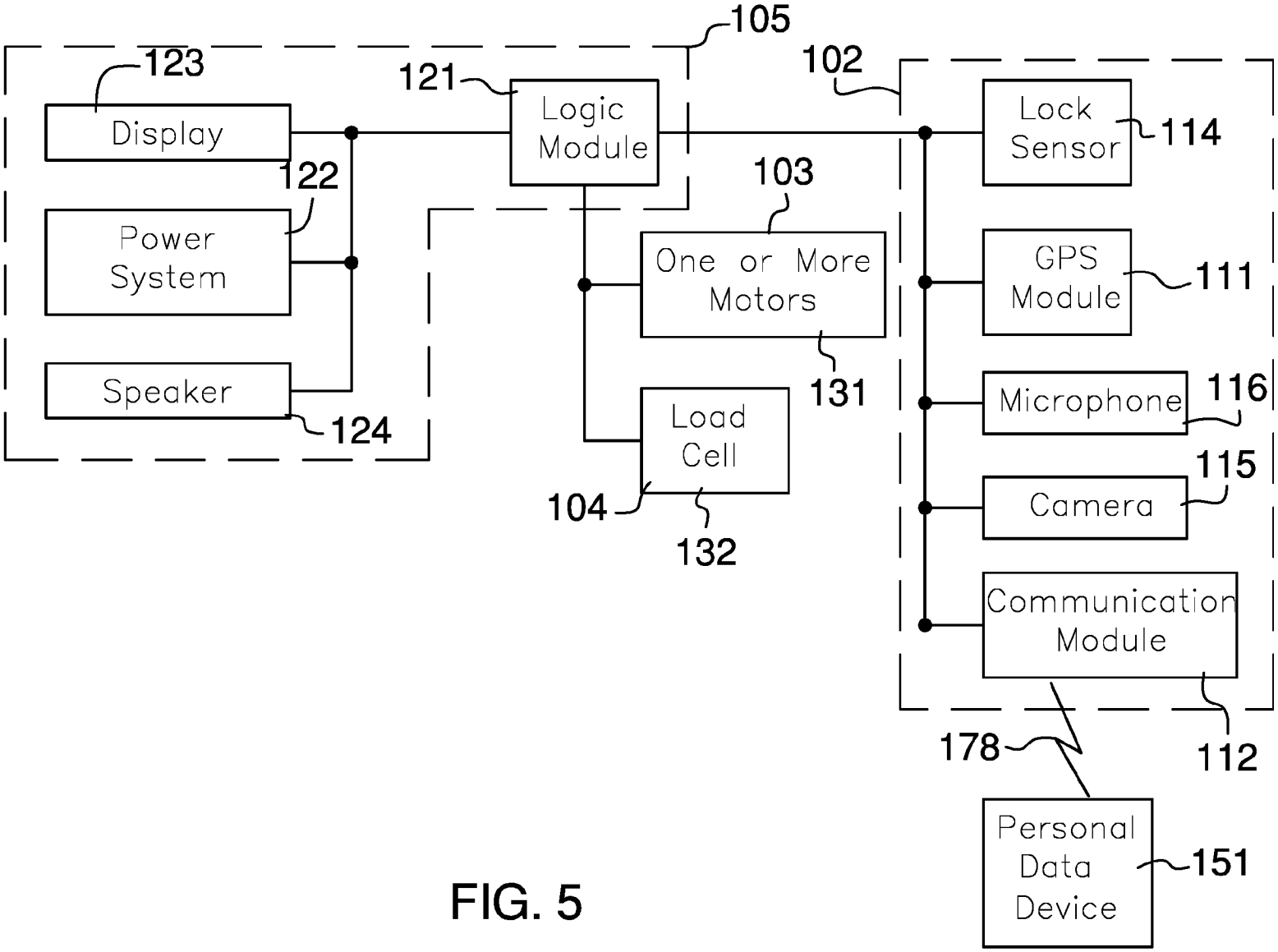
FIG. 5 is a block diagram of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 7.

The luggage notification system 100 (hereinafter invention) comprises a piece of luggage 101, a security system 102, a drive system 103, a weight system 104, and a control system 105. The invention 100 is a security system 102 that is adapted for use with a piece of luggage 101. The invention 100 is further adapted for use with a personal data device 151. Specifically, the security system 102: 1) monitors when the piece of luggage 101 is accessed for security or other reasons, records the event and transmits a message 170 to the personal data device 151 announcing the event; and, 2) tracks the position of the piece of luggage 101. Optionally, the invention 100 can further comprise a load cell 132 to monitor the weight of the piece of luggage 101 and a drive system 103 that drives a plurality of rollers 144 associated with the piece of luggage 101.

The control system 105 comprises a logic module 121, a power system 122, a display 123, and a speaker 124. The logic module 121 is a programmable device that is used to control and operate the security system 102, drive system 103, weight system 104, display 123 and speaker 124. Depending on the specific design and the selected components, the logic module 121 can be a separate component within the device or the functions of the logic module 121 can be incorporated into another component within the device. The power system 122 is a commercially available battery and an associated recharging system that is used to power the security system 102, drive system 103, weight system 104, logic module 121, display 123 and speaker 124. In the first potential embodiment of the disclosure, the display 123 is a commercially available touchscreen display that is used to interface with the control system 105 while the invention 100 is in use. The speaker 124 is a commercially available speaker or buzzer that is used by the control system 105 to generate audible signals. The control system 105 is mounted within the case 141 of the piece of luggage 101. The speaker 124 and the display 123 are mounted such that the speaker 124 and the display 123 are accessible from the exterior of the piece of luggage 101. Methods to control and operate speakers 124 and displays 123 using logic modules 121 are well known and documented in the electrical arts. The security system 102 comprises a GPS module 111, a communication module 112, a closure enclosure 113, a lock sensor 114, a camera 115, and a microphone 116. The GPS module 111 is an electrical device that communicates with the GPS to determine the GPS coordinates of the GPS module 111. When queried by the logic module 121, the GPS module 111 transfer the GPS coordinates to the logic module 121 for use in processes described elsewhere in this disclosure. The communication module 112 is an electrical device that transmits messages 170 generated by the logic module 121 to the personal data device 151. In the first potential embodiment of the disclosure, the communication module 112 communicates to the personal data device 151 using a commercially available SMS network 178. The closure enclosure 113 is an enclosure that provides physical security for the closure 143 of the piece of luggage 101. Specifically, the closure enclosure 113 is a bracket that is attached to the piece of luggage 101 such that the closure is enclosed with the closure enclosure 113. The closure enclosure 113 is fitted with the lock sensor 114. The lock sensor 114 is an electrical device that monitors the status of the closure enclosure 113. Should the closure enclosure 113 be breached such that the closure 143 of the piece of luggage 101 can be accessed, the lock sensor 114 sends a signal to the logic module 121 indicating that the security of the piece of luggage 101 has been breached. The security system 102 is mounted within the piece of luggage 101. The camera 115 is a commercially available camera 115 that is mounted on or in the piece of luggage 101. The microphone 116 is a commercially available microphone 116 that is mounted on or in the piece of luggage 101. Methods to control and operate GPS modules 111, communication modules 112, sensors, cameras 115, and microphones 116 using logic modules 121 are well known and documented in the electrical arts.

The drive system 103 comprises one or more motors 131 and a drive button 133. Each of the one or more motors 131 is a commercially available electric motor that is attached to a roller selected from the plurality of rollers 144 such that when the a motor selected from the one or more motors 131 is operating the selected motor is rotating the selected roller. The drive button 133 is used to operate the one or more motors 131 and is discussed elsewhere in this disclosure.

The weight system 104 comprises a load cell 132 and a scale button 134. The purpose of the weight system 104 is to estimate the current loaded weight of the invention 100. The load cell 132 is a transducer that is placed between the plurality of rollers 144 and the contents contained within the piece of luggage 101. When the piece of luggage 101 is rested upon the plurality of rollers 144, the load cell 132 sends a signal to the logic module 121 which the logic module 121 uses to estimate the weight of the piece of luggage 101. The scale button 134 is used to initiate operation of the weight system 104. The operation of the weight system 104 is discussed in greater detail elsewhere in this disclosure.

Figure 6:
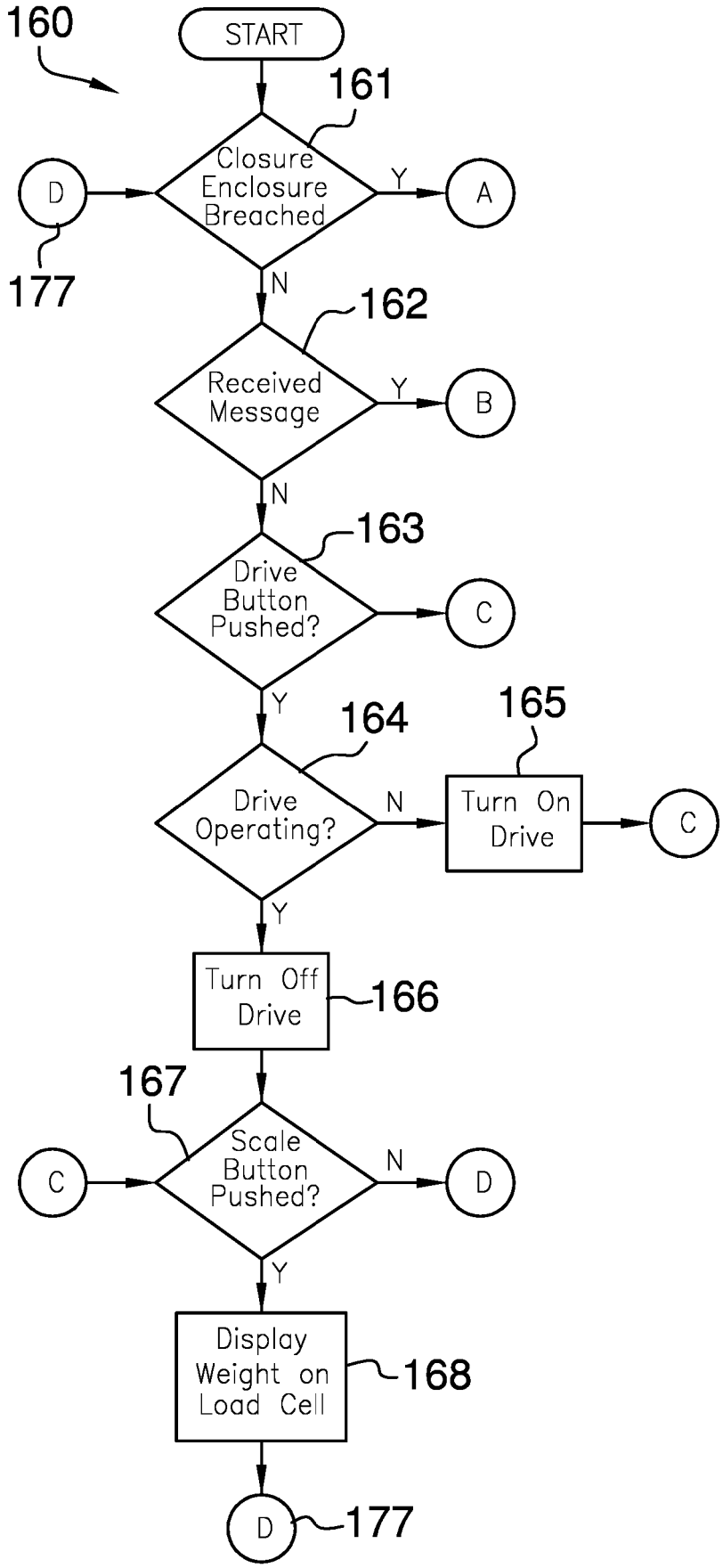
FIG. 6 is a flowchart of an embodiment of the disclosure.
Figure 7:
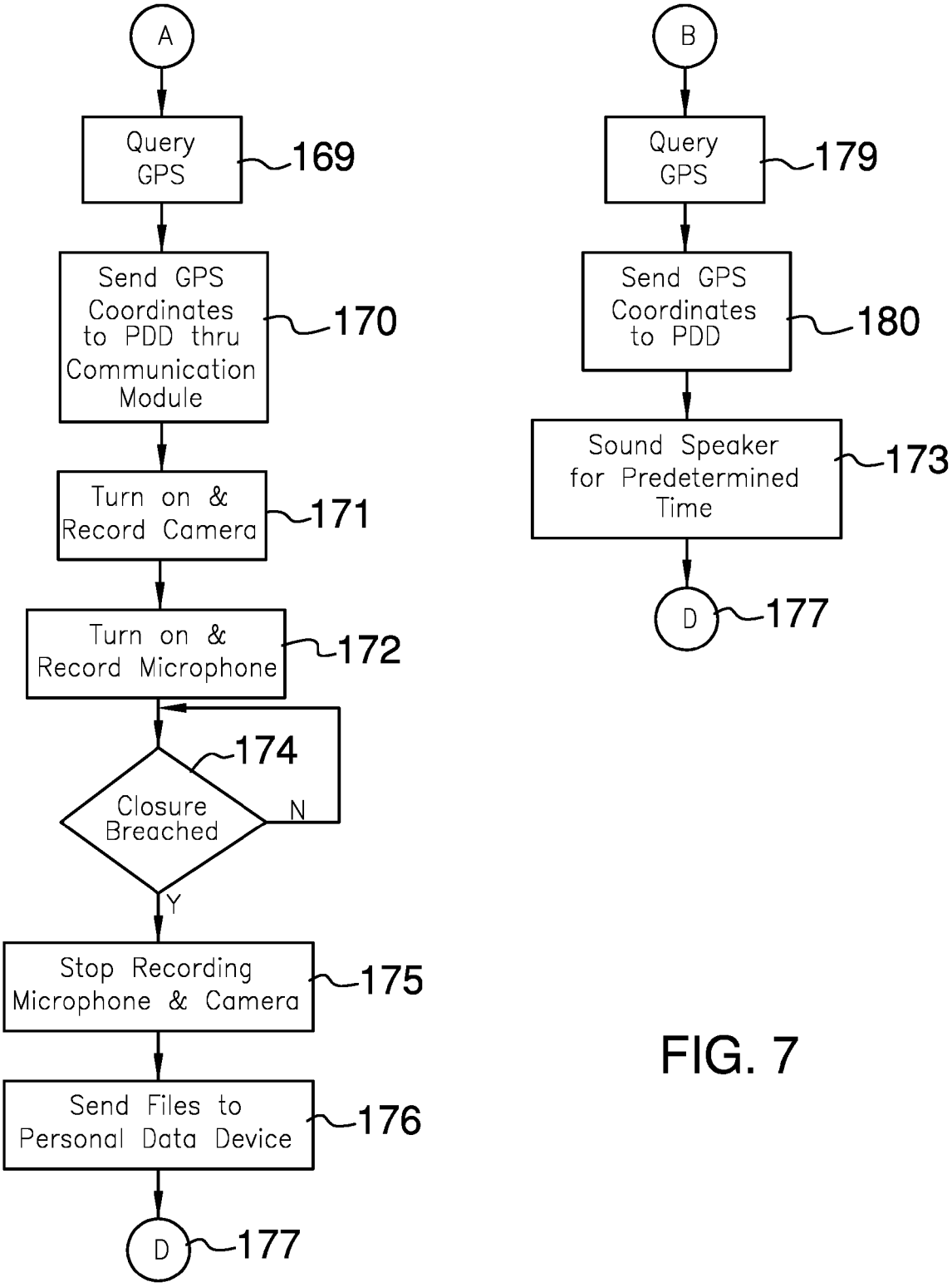
FIG. 7 is a flowchart of an embodiment of the disclosure.

The operation of the invention 100, as shown most clearly in FIGS. 6 and 7, is described in this paragraph and the following two paragraphs. As shown in FIG. 6, the functions of the control system 105 are managed by the logic module 121 using the master loop 160. The master loop 160 monitors inputs into the control system 105 that will be used to trigger actions by the control system 105. The master loop 160 involves the following operations. The logic module 121 monitors the closure enclosure 113 to determine if the closure enclosure 113 has been breached 161. The operation of the logic module 121 if the closure enclosure 113 has been breached 161 is discussed in a later paragraph. The logic module 121 monitors the communication module 112 to determine if a message has been received 162. The operation of the logic module 121 if the communication module 112 has received a message 162 is discussed in a later paragraph. The logic module 121 monitors the drive button 133 to determine if the drive button 133 has been pushed 163. If the drive button 133 has been pushed the logic module 121 determines if the drive system 103 is operating 164. If the drive system 103 is operating then the logic module 121 turns the drive system 103 off 166. If the drive system 103 is not operating then the logic module 121 turns the drive system 103 on 165. The logic module 121 monitors the scale button 134 to determine if the scale buttom 134 has been pushed 167. If the scale button 134 has not been pushed, the logic module 121 restarts 177 the master loop 160 by monitoring the closure enclosure 113 to determine if the closure enclosure 113 has been breached 161. If the scale button 134 has been pushed, the logic monitor estimates the weight of the piece of luggage 101 using the load cell 132 and displays this information on the display 168. The logic module 121 then restarts 177 the master loop 160 by monitoring the closure enclosure 113 to determine if the closure enclosure 113 has been breached 161.

As shown most clearly in FIG. 7, if the logic module 121 determines that the closure enclosure 113 has been breached 161, the logic module 121 queries 169 the GPS module 111 to determine the GPS coordinates of the GPS module 111. The logic module 121 next generates a message, which includes the GPS coordinates of the GPS module 111 and uses the communication module 112 to transmit this message 170 to the personal data device 151. The logic module 121 then turns on the camera 115 and records the captured images 171. The logic module 121 then turns on the microphone 116 and records the captured audio 172. The logic module 121 continues to monitor and record the situation until the closure enclosure 113 is no longer breached 174. At that point, the logic module 121 stops recording the camera 115 and microphone 116 inputs 175 and sends the recorded files 176 to the personal data device 151 using the communication module 112. The logic module 121 then restarts 177 the master loop 160.

As shown most clearly in FIG. 7, if the logic module 121 determines that the communication module 112 has received a message 162, the logic module 121 queries 179 the GPS module 111 for the current GPS coordinates and transmits a message 180 to the personal data device 151 containing the current GPS coordinates. The logic module 121 then generates an audible signal 173 that is announced over the speaker 124.

To use the invention 100, the master loop 160 is activated before the piece of luggage 101 is separated from the traveler.

The following definitions were used in this disclosure:

Battery: As used in this disclosure, a battery is a container consisting of one or more cells, in which chemical energy is converted into electricity and used as a source of power.

Buzzer: As used in this disclosure, a buzzer is two lead electrical device that generates an audible sound when voltage is applied to the two leads.

Control System: As used in this disclosure, a control system is a first device or system that manages and regulates the behavior or operation of a second device or system.

Electric Motor: In this disclosure, an electric motor is a machine that converts electric energy into rotational mechanical energy.

GPS: As used in this disclosure, depending on the context GPS refers to: 1) a system of navigational satellites that are used to determine the position and velocity of a person or object; 2) the system of navigational satellites referred to in the first definition that are used to synchronize to global time; or, 3) an electronic device or that uses the system of navigational satellites referred to in the first definition to determine the position of a person or object. GPS is an acronym for Global Positioning System.

Load Cell: As used in this disclosure, a load cell is a transducer that measures an applied force and generates an electrical signal that is a known function of the applied force.

Logic Module: As used in this disclosure, a logic module is a programmable device that accepts digital and analog inputs, processes the digital and analog inputs according to previously stored instruction and to provide the results of these instructions as digital or analog outputs. In this disclosure, the logic module will include a logical processor, memory, and programmable input/output peripherals.

Personal Data Device: As used in this disclosure, a personal data device is a handheld device that is used for managing personal information and communication. Examples of personal data device include, but are not limited to, cellular phones, tablets and smart phones.

Sensor: As used in this disclosure, a sensor is a device that receives and responds in a predetermined way to a signal or stimulus.

Speaker: As used in this disclosure, a speaker is an electrical device that converts an electrical signal into an audible sound.

Transceiver: As used in this disclosure, a transceiver is a device that is used to transmit and receive radio signals.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A security system comprising:

a piece of luggage, a security system, a drive system, a weight system, and a control system;

wherein the security system, a drive system, a weight system, and a control system are contained within and on the piece of luggage;

wherein the security system is further adapted for use with a personal data device;

wherein the security system monitors when the piece of luggage is accessed;

wherein the security system records the access event and transmits a message to the personal data device announcing the event;

wherein the security system tracks the position of the piece of luggage;

wherein the piece of luggage is further defined by a case, a closure, a plurality of rollers, a handle, and an extendable handle;

wherein the control system comprises a logic module, a power system, a display, and a speaker;

wherein the logic module, the power system, the display, and the speaker are interconnected as an electric circuit;

wherein the logic module is a programmable device that controls and operates the security system, display and speaker;

wherein the display is a touchscreen display;

wherein the speaker is used by the control system to generate audible signals;

wherein the security system comprises a GPS module, a communication module, a closure enclosure, a lock sensor, a camera, and a microphone;

wherein the security system the GPS module, the communication module, the closure enclosure, the lock sensor, the camera, and the microphone are interconnected as an electric circuit;

wherein the closure enclosure is an enclosure that is adapted for use with a closure of the piece of luggage;

wherein the closure enclosure is a bracket that is attached to the piece of luggage such that the closure is enclosed with the closure enclosure;

wherein the closure enclosure is fitted with the lock sensor;

wherein the lock sensor is an electrical device that monitors the status of the closure enclosure such that should the closure enclosure be breached such that the closure of the piece of luggage can be accessed, the lock sensor sends a signal to the logic module.

2. The security system according to claim 1 wherein the GPS module is an electrical device that communicates with the GPS to determine the GPS coordinates of the GPS module;

wherein when queried by the logic module, the GPS module transfers the GPS coordinates to the logic module.

3. The security system according to claim 2 wherein the communication module is an electrical device that transmits messages generated by the logic module to the personal data device.

4. The security system according to claim 3 wherein the communication module communicates to the personal data device using a commercially available SMS network.

5. The security system according to claim 4
wherein the security system further comprises a drive system;
wherein the drive system comprises one or more motors and a drive button;
wherein each of the one or more motors is an electric motor;
wherein each of the one or more motors is attached to a roller selected from the plurality of rollers such that when the a motor selected from the one or more motors is operating the selected motor is rotating the selected roller.

6. The security system according to claim 5
wherein the security system further comprises a weight system;
wherein the weight system further comprises a load cell and a scale button;
wherein the weight system estimates the current loaded weight of the piece of luggage.

7. The security system according to claim 6 wherein the load cell is a transducer that is placed between the plurality of rollers and the contents contained within the piece of luggage.

8. The security system according to claim 7
wherein the logic module controls and operates drive system;
wherein the logic module controls and operates the weight system.

9. The security system according to claim 8
wherein the power system comprises a battery and a recharging device;
wherein the power system is connected to the security system;
wherein the power system is connected to the drive system;
wherein the power system is connected to the weight system;
wherein the power system is connected to the control system.

10. The security system according to claim 1
wherein the security system further comprises a drive system;
wherein the drive system comprises one or more motors and a drive button;
wherein each of the one or more motors is an electric motor;
wherein each of the one or more motors is attached to a roller selected from the plurality of rollers such that when the a motor selected from the one or more motors is operating the selected motor is rotating the selected roller.

11. The security system according to claim 10
wherein the security system further comprises a weight system;
wherein the weight system further comprises a load cell and a scale button;
wherein the weight system estimates the current loaded weight of the piece of luggage;
wherein the load cell is a transducer that is placed between the plurality of rollers and the contents contained within the piece of luggage.

12. The security system according to claim 11
wherein the control system comprises a logic module, a power system, a display, and a speaker;
wherein the logic module, the power system, the display, and the speaker are interconnected as an electric circuit;
wherein the GPS module is an electrical device that communicates with the GPS to determine the GPS coordinates of the GPS module;
wherein when queried by the logic module, the GPS module transfers the GPS coordinates to the logic module;
wherein the logic module controls and operates drive system;
wherein the logic module controls and operates the weight system;
wherein the logic module is a programmable device that controls and operates the security system, display and speaker;
wherein the display is a touchscreen display;
wherein the speaker is used by the control system to generate audible signals;
wherein the functions of the control system are managed by the logic module using a master loop;
wherein the logic module monitors the closure enclosure to determine if the closure enclosure has been breached;
wherein the logic module monitors the communication module to determine if a message has been received;
wherein the logic module monitors the drive button to determine if the drive button has been pushed;
wherein the logic module turns on the drive system;
wherein the logic module turns off the drive system;
wherein the logic module monitors the scale button to determine if the scale button has been pushed;
wherein the logic monitor estimates and displays the weight of the piece of luggage using the load cell;
wherein the logic module generates a first message which includes the GPS coordinates of the GPS module and uses the communication module to transmit the first message to the personal data device;
wherein the logic module then turns on the camera and records the captured images;
wherein the logic module then turns on the microphone and records the captured audio;
wherein the logic module sends a second message containing the recorded images and the recorded audio to the personal data device;
wherein the logic module generates an audible signal that is announced over the speaker.

13. The security system according to claim 12
wherein the power system comprises a battery and a recharging device;
wherein the power system is connected to the security system;
wherein the power system is connected to the drive system;
wherein the power system is connected to the weight system;
wherein the power system is connected to the control system.

* * * * *